US007641486B2

(12) United States Patent
Tonosaki

(10) Patent No.: US 7,641,486 B2
(45) Date of Patent: Jan. 5, 2010

(54) LEVER-TYPE CONNECTOR AND METHOD OF OPERATING IT

(75) Inventor: Takashi Tonosaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/419,388

(22) Filed: Apr. 7, 2009

(65) Prior Publication Data

US 2009/0263997 A1 Oct. 22, 2009

(30) Foreign Application Priority Data

Apr. 18, 2008 (JP) ..... 2008-108918

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 6,736,655 B2 5/2004 Martin et al.
7,568,925 B2 * 8/2009 Ciriello et al. ..... 439/157
2001/0019908 A1 * 9/2001 Zweigle ..... 439/157
2003/0162413 A1 8/2003 Shinozaki et al.
2005/0064749 A1 * 3/2005 Stella et al. ..... 439/157
2007/0026705 A1 2/2007 Tyler
2007/0224862 A1 9/2007 Tyler

FOREIGN PATENT DOCUMENTS

DE 8714016 11/1987

* cited by examiner

*Primary Examiner*—Tho D Ta
(74) *Attorney, Agent, or Firm*—Gerald E. Hespos; Anthony J. Casella

(57) ABSTRACT

A first housing (10) and a second housing (30) are connected by leverage brought about by the engagement of pinions (24) of a lever (20) rotatably supported on the first housing (10) and racks 33 of the second housing (30). In the process of rotating the lever (20), cam action brought about by the engagement of cam grooves (25) of the lever (20) and cam followers (37) of the second housing (30) is exhibited. This cam action prevents the first housing (10) from being inclined with respect to the second housing (30) with engaged positions of the pinions (24) and the racks (33) as supports.

13 Claims, 8 Drawing Sheets

LEVER-TYPE CONNECTOR AND METHOD OF OPERATING IT

BACKGROUND OF THE INVENTION

1. Field of the Invention

The invention relates to a lever-type connector and to a method of operating it, in particular connecting and/or separating it.

2. Description of the Related Art

U.S. Pat. No. 6,736,655 discloses a lever-type connector that has a first housing, a lever rotatably mounted on the first housing and a second housing that can be connected to the first housing by the rotation of the lever. The lever has a pinion concentric with a center of rotation of the lever and the second housing has a rack extending in connecting directions of the two housings. The pinion engages the rack and generates a leverage to connect the housings as the lever is rotated.

The center of rotation of the lever of the above-described connector is offset from an engaged position of the rack and pinion in a width direction that intersects the connecting directions of the two housings. Thus, the first housing may incline with respect to the second housing about the engaged position of the rack and pinion due to a reaction force generated between the rack and the pinion during a connecting process.

The invention was developed in view of the above situation and an object thereof is to connect two housings to each other without being inclined.

SUMMARY OF THE INVENTION

The invention relates to a lever-type connector with a first housing, a lever rotatably mounted on the first housing, and a second housing connectable with the first housing. The lever includes at least one pinion and the second housing includes a rack. The pinion engages the rack and generates forces for connecting or separating the housings as the lever is rotated. One of the lever and the second housing is formed with at least one cam groove and the other is formed with at least one cam follower. The cam groove and the cam follower engage in the process of rotating the lever.

A reaction force may be generated between the rack and the pinion during the connection process. The reaction force may act in a direction that could cause the first housing to incline relative to the second housing about the engaged position of the rack and pinion. However, the engagement of the cam groove and the cam follower prevents inclination of the first housing. Thus, the two housings are connected without being inclined.

Leverage caused by the engagement of the rack and the pinion preferably is exhibited in the entire rotational range from the start to the end of the rotation of the lever. The cam action brought about by the engagement of the cam groove and the cam follower preferably is exhibited only in a part of the rotational range from an intermediate position of the rotation of the lever to the completion of the rotation. Accordingly, the leverage brought about by the engagement of the rack and the pinion and the cam action brought about by the engagement of the cam groove and the cam follower are exhibited at a final stage of the rotation of the lever, and the two housings are aligned properly when the connecting operation of the two housings is completed.

The cam groove preferably is formed in an arm portion of the lever without fully penetrating the arm.

An arcuate surface of the cam groove distant from a supporting shaft that supports the lever on the first housing preferably defines a separation restricting surface and/or an arcuate surface of the cam groove close to the supporting shaft serves as a connection restricting surface.

The cam groove preferably is displaced to incline the connection restricting surface and the separation restricting surface thereof gradually with respect to the connecting directions of the two housings.

The separation restricting surface of the cam groove preferably engages the cam follower from the front of the first housing at the side of the supporting shaft substantially opposite to the rack and pinion and in a direction inclined with respect to the connecting directions of the two housings.

An engaged position of the rack and pinion and a position of a supporting shaft to support the lever on the first housing may be distanced from each other in a width direction intersecting the connecting directions of the two housings.

The cam follower and the cam groove preferably are not engaged yet when the engagement of the rack and the pinion is started.

The invention also relates to a method of operating a lever-type connector, such as the above-described connector. The method comprises providing a first housing with a lever rotatably mounted thereon, engaging a pinion on the lever with a rack on a second housing, rotating the lever so that the pinion and the rack move the housings toward one another and engaging a cam groove on one of the lever and the second housing with a cam follower on the other of the lever and the second housing for preventing the first housing from being inclined with respect to the second housing.

The method preferably comprises generating leverage between the rack and the pinion through an entire rotational range of the lever, and engaging the cam groove and the cam follower only in a part of the rotational range of the lever, and most preferably from an intermediate position of the rotation of the lever to the completion of the rotation.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
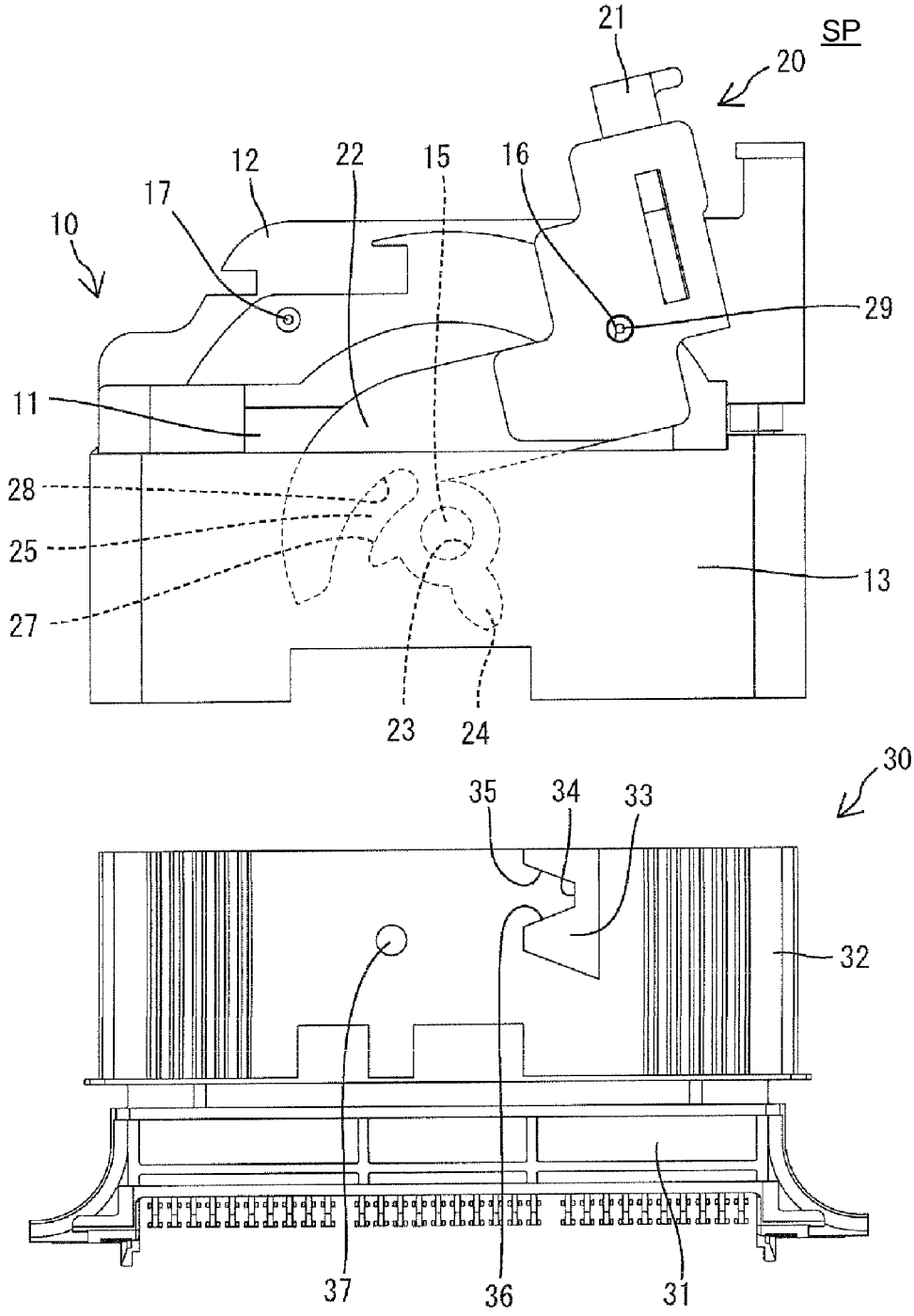
FIG. 1 is a plan view showing a state where a first housing and a second housing are separated in one embodiment.

A lever-type connector in accordance with the invention includes first and second housings identified generally by the numerals 10 and 30 in FIGS. 1 to 5.

The first housing 10 is a female housing made e.g. of synthetic resin and includes a substantially block-shaped main body 11. Female terminal fittings (not shown) having a known form are accommodated in the main body 11. Wires (not shown) are connected with the respective female terminal fittings and are drawn out from the wire draw-out surface at the rear of the main body 11 (upper surface in FIGS. 1 to 5). A wire cover 12 is mounted on the wire draw-out surface for bending and at least partly covering the wires drawn out from the wire draw-out surface of the main body 11. Thus, the wires extend substantially parallel with the wire draw-out surface of the housing main body 11 and are drawn out sideways. The housing 10 has a tubular protection wall 13 that surrounds the main body 11 over substantially the entire periphery. The protection wall 13 is connected with the main body 11 at opposite ends in a width direction, which is at right angles to connecting and separating directions of the two housings 10, 30. A forwardly open accommodation space 14 is defined between the protection wall 13 and the main body 11 for accommodating a lever 20 to be described later and a receptacle 32 of the second housing 30. Rearwardly open slits are formed between the protection wall 13 and the outer surface (wall surface appearing in FIGS. 1 to 5) of the upper wall of the main body 11 and between the protection wall 13 and the outer surface of the lower wall (wall surface hidden in FIGS. 1 to 5) of the main body 11 to enable arms 22 of the lever 20 to be assembled from behind.

Substantially cylindrical supporting shafts 15 project into the accommodation space 14 from opposite upper and lower surfaces (surface appearing in FIGS. 1 to 5 and the opposite hidden surface) of the main body 11. The supporting shafts 15 extend substantially orthogonal to the connecting directions of the housings 10, 30 and define a center of rotation of the lever 20.

The lever 20 is mounted rotatably on the first housing 10. The lever 20 is made unitarily e.g. of synthetic resin and has an operable portion 21 and two vertically symmetrical plate-like arms 22 that extend substantially parallel with one another from opposite ends of the operable portion 21. Substantially concentric circular bearing holes 23 penetrate the arms 22. The bearing holes 23 engage the supporting shafts 15 so that the lever 20 rotatable about the supporting shafts 15 through a range of about 70° between a standby position SP and a connection position CP with the arms 22 accommodated in the accommodation space 14.

Figure 2:
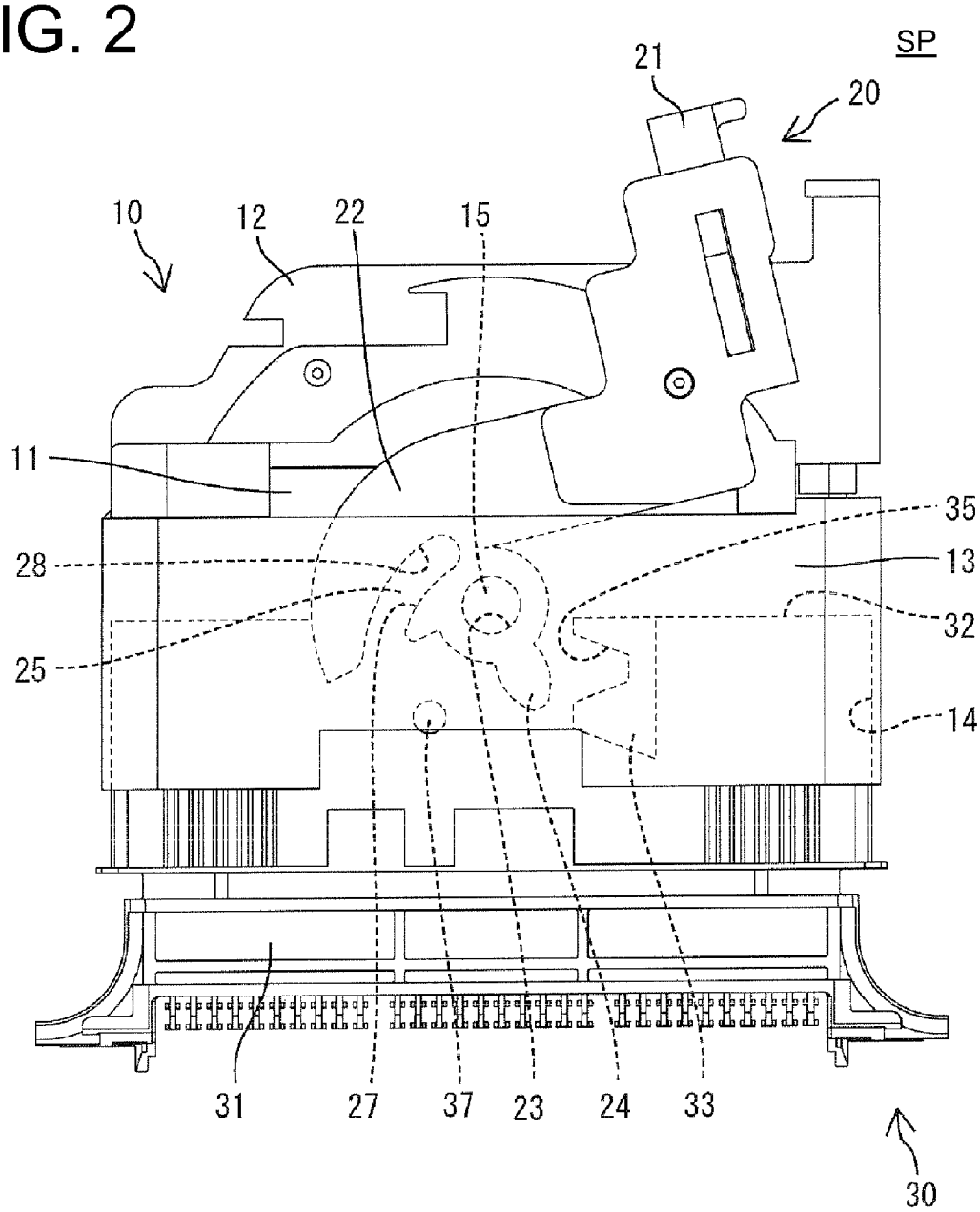
FIG. 2 is a plan view showing a state where the first housing and the second housing are lightly connected with a lever held at a standby position.
Figure 3:
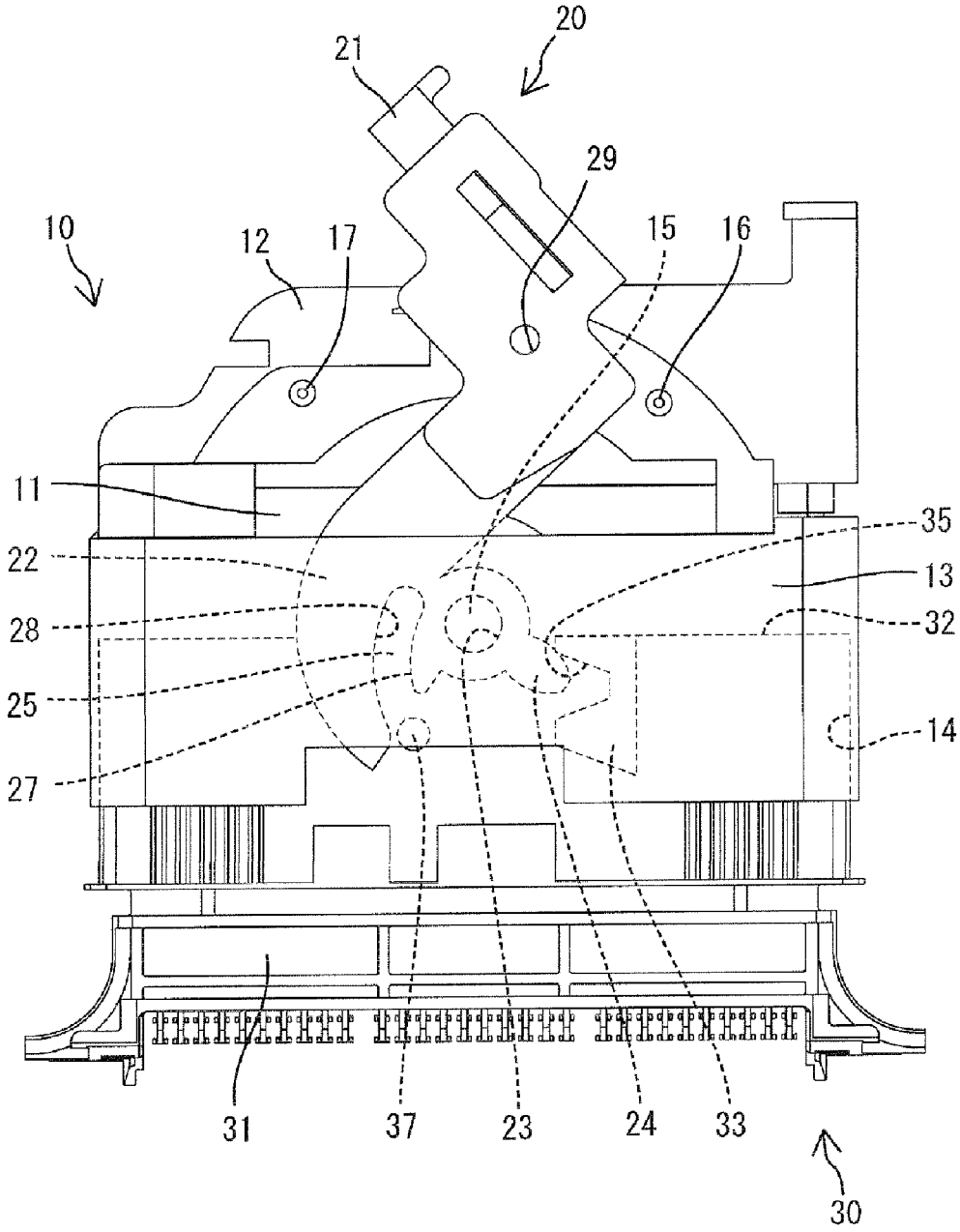
FIG. 3 is a plan view showing a state where the first and second housings are further connected.
Figure 4:
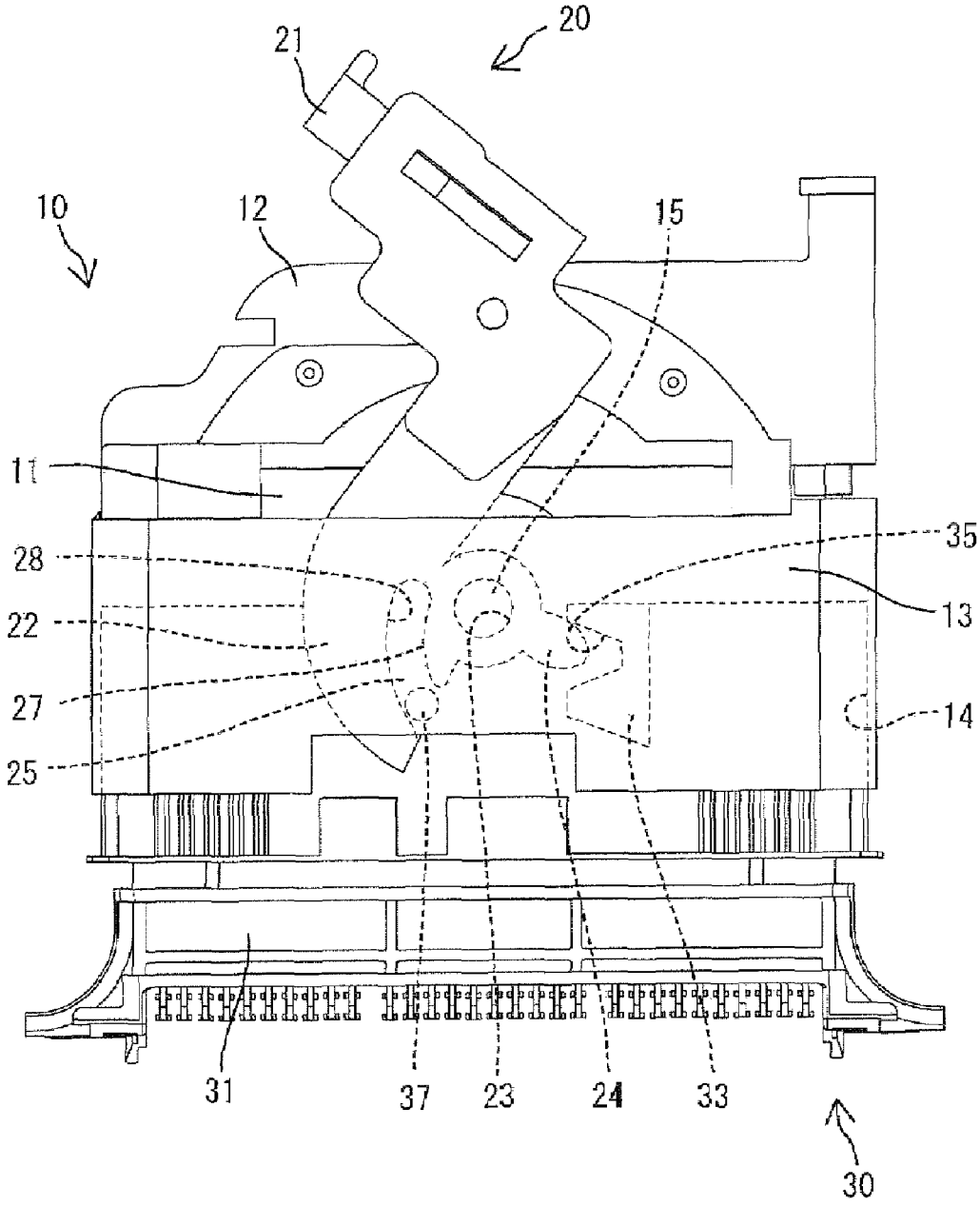
FIG. 4 is a plan view showing a state where the first and second housings are even more connected.
Figure 5:
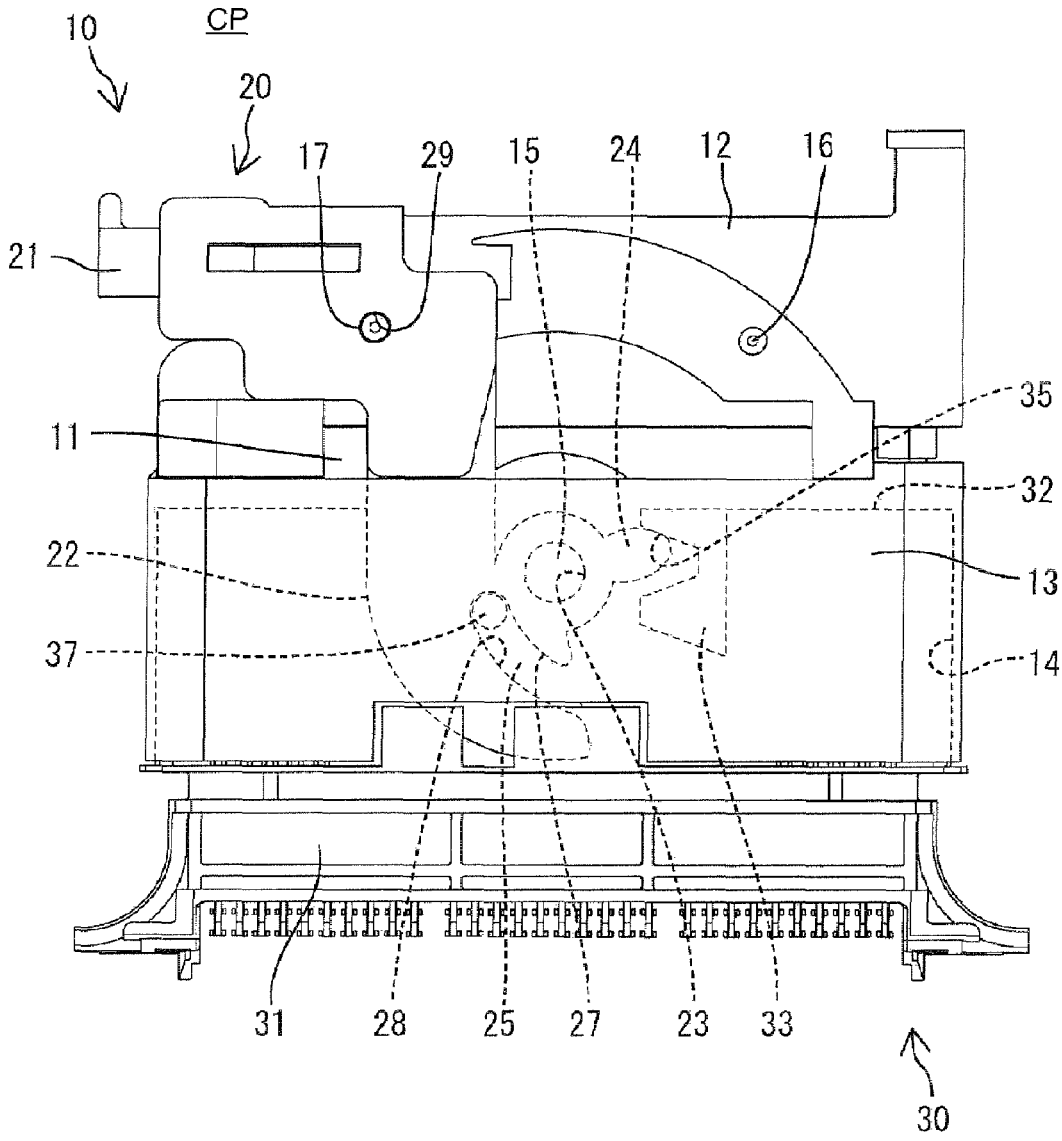
FIG. 5 is a plan view showing a state where the first and second housings are completely connected.
Figure 6:
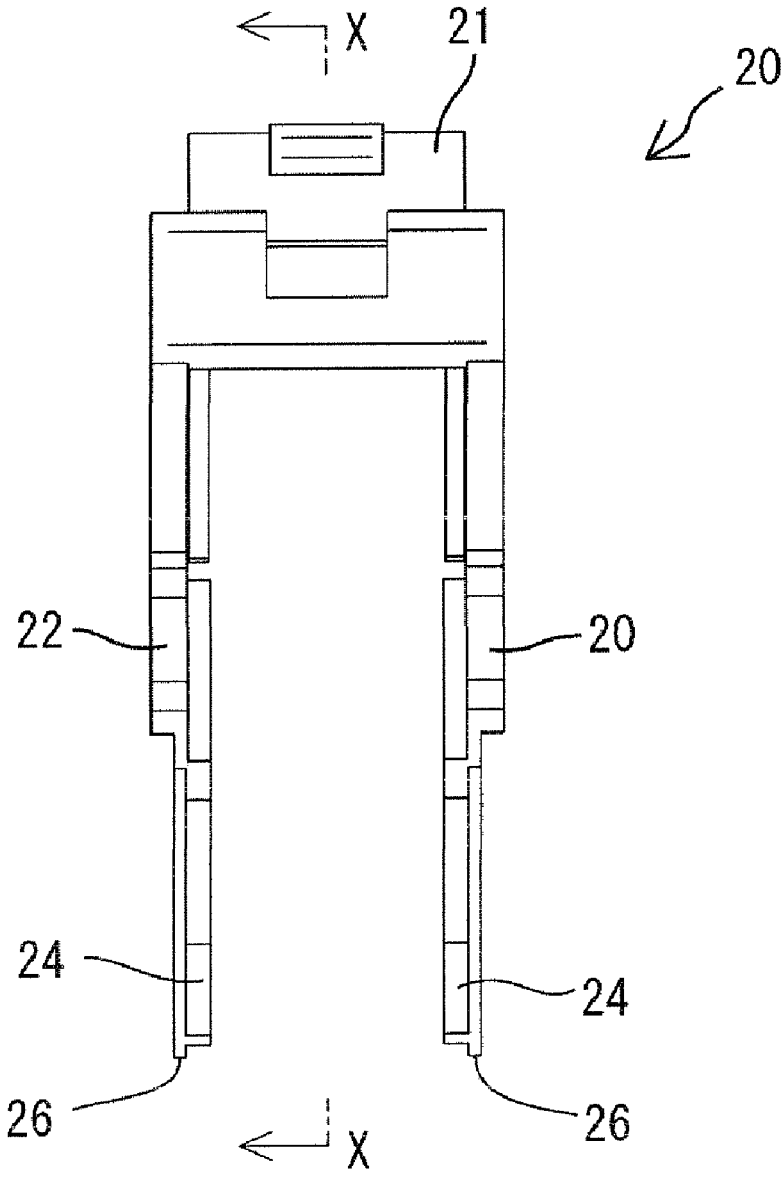
FIG. 6 is a side view of the lever.
Figure 7:
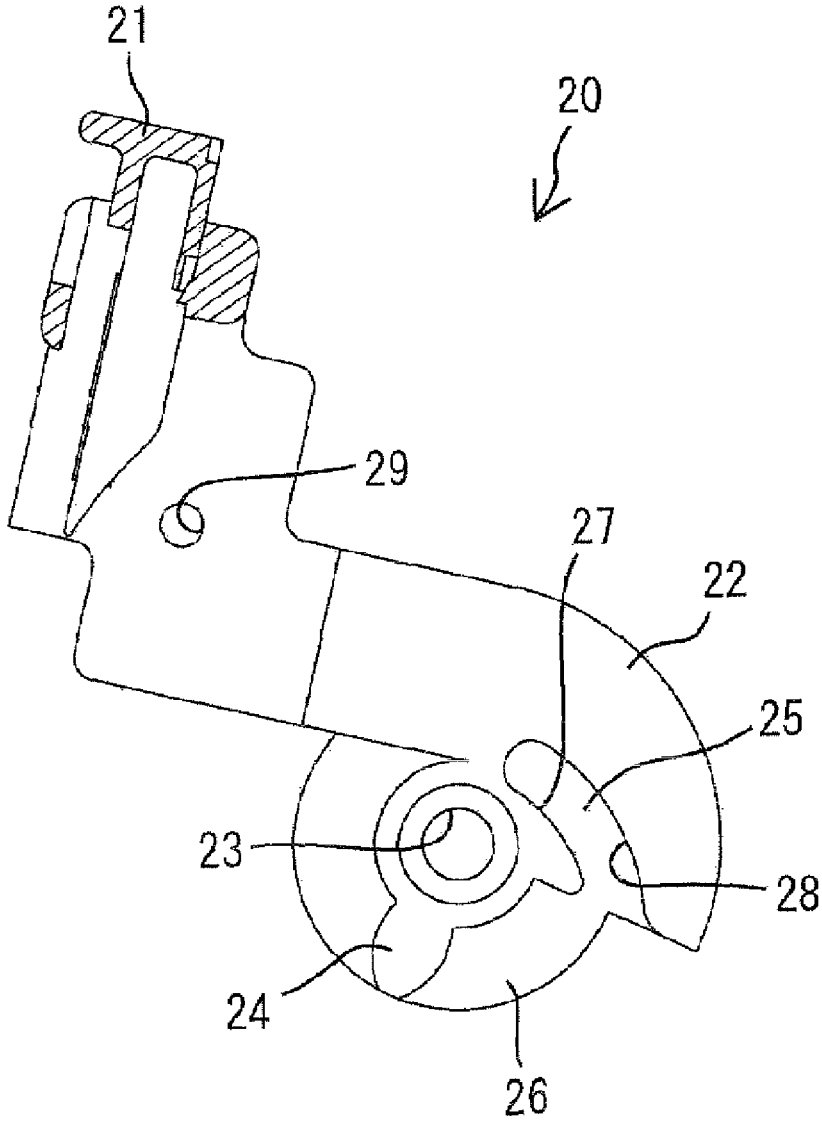
FIG. 7 is a section along X-X of FIG. 6.
Figure 8:
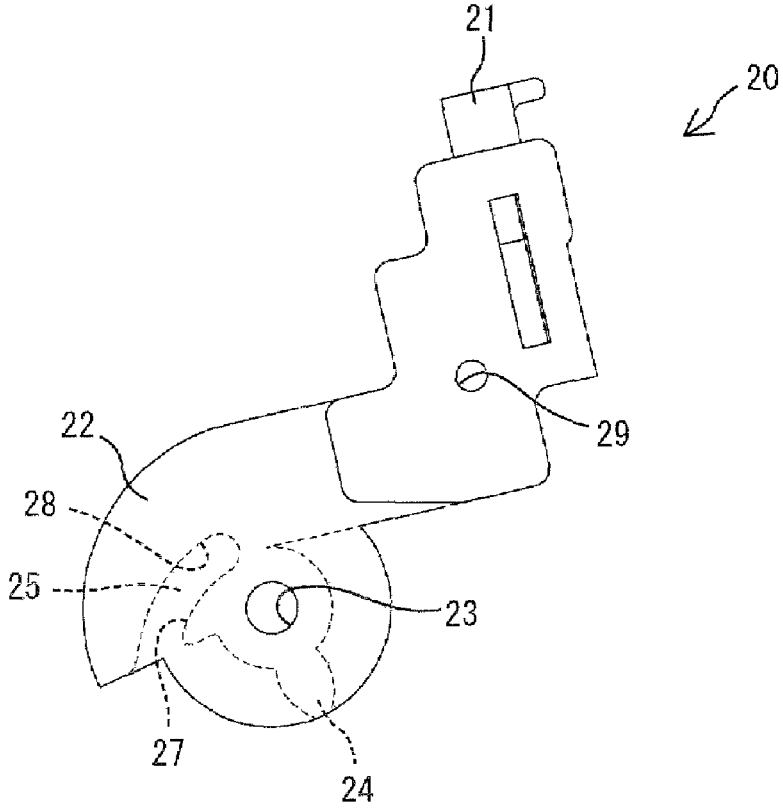
FIG. 8 is a plan view of the lever.
Figure 9:
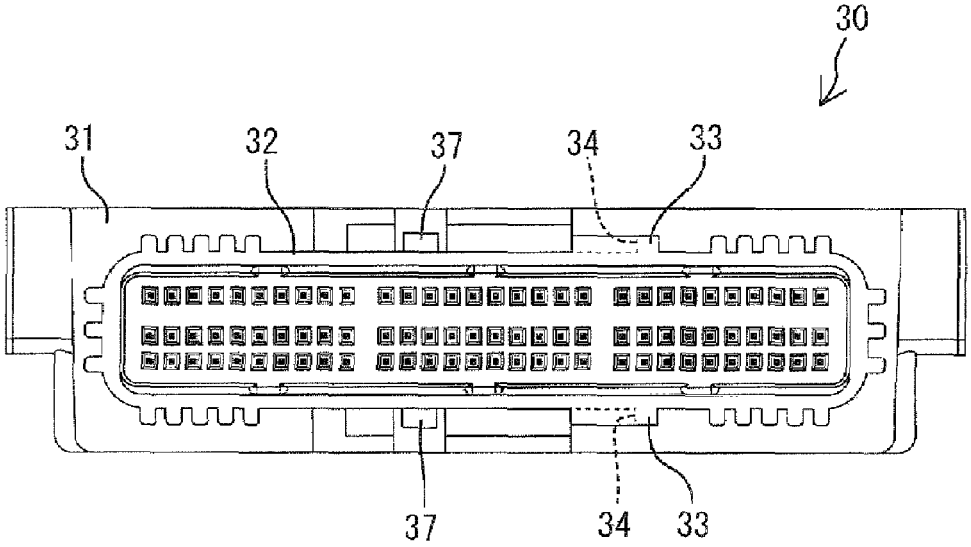
FIG. 9 is a front view of the second housing.

The operable portion 21 is obliquely behind the supporting shafts 15 when the lever 20 is at the standby position SP as shown in FIGS. 1 and 2. However, the operable portion 21 can be displaced in the width direction along an arcuate path behind the supporting shafts 15 to rotate the lever 20 from the standby position SP to the connection position CP, as shown in FIGS. 3 and 4. The operable portion 21 is at a side of the supporting shafts 15 opposite the position of the operable portion 21 at the standby position SP in the width direction when the lever 20 reaches the connection position CP, as shown in FIG. 5.

The arms 22 include two vertically symmetrical pinions 24, two substantially vertically symmetrical cam grooves 25 and two vertically symmetrical plates 26. The cam grooves 25 are formed in the inner surfaces of the arms 22 so as not to penetrate to the outer surfaces, and are arcuate about the supporting shafts 15. The starting end of each cam groove 25 opens at the outer peripheral edge of the arm 22 and the cam groove 25 is formed so that a distance to the supporting shaft 15 is shortened gradually from the starting end of the cam groove 25 to the back end thereof. A separating restricting surface 27 is formed by arcuate surface of the cam groove 25 distant from the supporting shaft 15 and a connection restricting surface 28 is defined by an arcuate surface of the cam groove 25 close to the supporting shaft 15.

The plate 26 is flat, normal to the supporting shaft 15, parallel to a rotational path of the lever 20 and forms a wall surface of the cam groove 25 at the outer side. One piece of pinion 25 projects from the inner surface of the plate 26. The pinion 24 projects along the plate 26 in a radial direction centered on the supporting shaft 15. This pinion 24 and the cam groove 25 are arranged at substantially opposite sides of the supporting shaft 15 in the width direction in the range of substantially the entire rotation range between the standby position SP and the connection position CP of the lever 20.

With the lever 20 at the standby position SP, the pinions 24 project obliquely forward with the supporting shafts 15 as centers and the projecting ends of the pinions 24 are closest to the supporting shafts 15 in the width direction, as shown in FIGS. 1 and 2. Further, the starting ends of the cam grooves 25 wait on standby while facing forward so as to enable the entry of cam followers 37 to be described later. The connection restricting surfaces 28 and the separation restricting surfaces 27 of the cam grooves 25 extend substantially parallel to the connecting directions of the two housings 10, 30.

Rotating the lever 20 from the standby position SP to the connection position CP displaces the pinions 24 back substantially parallel to the connecting directions of the two housings 10, 30, as shown in FIGS. 3 and 4. Further, the cam grooves 25 are displaced so that the connection restricting surfaces 28 and the separation restricting surfaces 27 gradually incline with respect to the connecting directions of the two housings 10, 30.

The pinions 24 are at the rearmost positions in forward and backward directions when the lever 20 is at the connection position CP shown in FIG. 5. Additionally, the connection restricting surfaces 28 and the separation restricting surfaces 27 of the cam grooves 25 are inclined to maximize angles to the connecting and separating directions of the two housings 10, 30.

The second housing 30 is made unitarily e.g. of synthetic resin and has a wide substantially block-shaped terminal accommodating portion 31. The receptacle 32 is a rectangular tube that projects forward (up in FIGS. 1 to 5) from the terminal accommodating portion 31. Unillustrated male terminal fittings having a known form are mounted in the terminal accommodating portion 31 and tabs at the front ends of the respective male terminal fittings project from the front surface of the terminal accommodating portion 31 to be surrounded in the receptacle 32.

Racks 33 are formed symmetrically on the upper surface of the upper wall and the lower surface of the lower wall of the receptacle 32. The racks 33 are displaced laterally from the center of the second housing 30 in the width direction and in the same direction as the displacing direction of the pinions 24 with respect to the supporting shafts 15. The racks 33 have grooves 34 that open laterally toward the widthwise center substantially orthogonal to the connecting and separating directions of the two housings 10, 30. A connection contact surface 35 is defined at the front of each groove 34 (upper surface in FIGS. 1 to 5) and a separation contact surface 36 is defined at the rear of each groove 34.

Substantially cylindrical cam followers 37 project from the upper surface of the upper wall and the lower surface of the lower wall of the receptacle 32 so that their axes are aligned vertically and substantially parallel with the axes of the supporting shafts 15. The cam followers 37 are displaced toward a side of the center of the second housing 30 substantially opposite to the racks 33 in the width direction (i.e. at positions displaced toward the same side as the cam grooves 25 are displaced from the supporting shafts 15). Thus, the cam followers 37 are at positions to face the openings of the starting ends of the cam grooves 25 when the lever 20 is at the standby position SP.

Upon connecting the two housings 10, 30, locking holes 29 extending in at positions of the arms 22 near the operable portion 21 are engaged with first stoppers 16 formed on the opposite upper and lower surfaces of the first housing 10 to hold the lever 20 at the standby position SP. The first housing 10 then is fit lightly into the receptacle 32 of the second housing 30 in this state. Thus, the upper and lower walls of the receptacle 32 are inserted into clearances between the housing main body 11 and the arms 22 in the accommodation space 14. Further, the pinions 24 do not yet engage the racks 33 and the cam followers 37 do not yet engage the cam grooves 25 when the two housings 10, 30 are connected lightly with each other, as shown in FIG. 2.

Thereafter, the lever 20 is rotated toward the connection position CP by operating (e.g. gripping) the operable portion 21. As a result, the pinions 24 engage the edges of the connection contact surfaces 35 of the racks 33 at opening sides, as shown in FIG. 3 and exhibit a lever action. This lever action between the racks 33 and the pinions 24 pulls the two housings 10, 30 toward each other. The cam followers 37 and the cam grooves 25 are not engaged yet when the engagement of the racks 33 and the pinions 24 is started.

Further rotation of the lever 20 causes the cam followers 37 to enter the starting ends of the cam grooves 25 while the pinions 24 and the racks 33 remain engaged as shown in FIG. 4. The connecting operation of the two housings 10, 30 then proceeds further due to the leverage brought about by the engagement of the racks 33 and the pinions 24 and cam action brought about by the cam followers 37 and the cam grooves 25.

The leverage brought about by the engagement of the racks 33 and the pinions 24 while connecting the housings 10, 30 pushes the supporting shafts 15 forward of the first housing 10 with the engaged positions of the pinions 24 and the racks 33 as supports. Thus, the first housing 10 is displaced forward toward the second housing 30. The engaged positions of the racks 33 and the pinions 24 and the positions of the supporting shafts 15 are offset from each other in the width direction, which intersects the connecting directions of the housings 10, 30. Thus, the first housing 10 may be inclined to displace the supporting shafts 15 forward with respect to the second housing 30 with the engaged positions of the racks 33 and the pinions 24 as the supports. However, the connection restricting surfaces 28 of the cam grooves 25 engage the cam followers 37 from an oblique rear side of the first housing 10 at the side of the supporting shafts 15 opposite to the racks 33 and the pinions 24 in the width direction. This engagement produces a cam action that prevents inclination of the first housing 10.

Frictional resistance between the terminal fittings could act to incline the first housing 10 in a direction to displace the supporting shafts 15 backward with respect to the second housing 30 with the engaged positions of the racks 33 and the pinions 24 as the supports. However, the separation restricting surfaces 27 facing the connection restricting surfaces 28 engage the cam followers 37 from an oblique front side of the first housing 10. This engagement produces a cam action that prevents inclination of the first housing 10.

As described above, the leverage brought about by the engagement of the racks 33 and the pinions 24 during the connecting operation can create a force to incline the first housing 10 with respect to the second housing 30. However, the cam action brought about by the engagement of the cam grooves 25 and the cam followers 37 produces a force to correct the inclination of the first housing 10. Thus, the inclination of the first housing 10 is substantially prevented and the housings 10 and 30 are connected while being aligned properly to each other. Accordingly, the connection process is made more smooth thus increasing overall operability. The cam action brought about by the engagement of the cam grooves 25 and the cam followers 37 continues until the lever 20 reaches a connection ending position.

The two housings 10, 30 are connected properly when the lever 20 reaches the connection position CP shown in FIG. 5 so that the male and female terminal fittings are connected electrically. At this time, the locking holes 29 engage the second stoppers 17 on the first housing 10 to hold the lever 20 at the connection position CP. Further, the cam followers 37 engage the back ends of the cam grooves 25.

The operating portion 21 of the lever 20 can be gripped to rotate the lever 20 from the connection position CP to the standby position SP for separating the two properly connected housings 10, 30. This rotating process causes the pinions 24 to engage the separation contact surfaces 36 of the racks 33 and produces a leverage. Additionally, the engagement of the cam grooves 25 and the cam followers 37 produces a cam action. The leverage and the cam action separate the two housings 10, 30.

The leverage brought about by the engagement of the racks 33 and the pinions 24 while separating the two housings 10, 30 pushes the supporting shafts 15 backward of the first housing 10 with the engaged positions of the pinions 24 and the racks 33 as the supports. As a result, the first housing 10 is displaced back and separated from the second housing 30. However, the supporting shafts 15 are offset in the width direction from the engaged positions of the racks 33 and the pinions 24. Thus, the first housing 10 may be inclined to displace the supporting shafts 15 backward with respect to the second housing 30 with the engaged positions of the racks 33 and the pinions 24 as the supports. However, the separation restricting surfaces 27 of the cam grooves 25 engage the cam followers 37 from the oblique front side of the first housing 10 at the side of the supporting shafts 15 substantially opposite to the racks 33 and the pinions 24 in the width direction. This engagement generates a cam action that prevents the inclination of the first housing 10.

Frictional resistance between the terminal fittings may act to incline the first housing 10 in a direction to displace the supporting shafts 15 forward with respect to the second housing 30 with the engaged positions of the racks 33 and the pinions 24 as the supports. However, the connection restricting surfaces 28 engage the cam followers 37 from the oblique rear side of the first housing 10. This engagement produces a cam action that prevents the inclination of the first housing 10.

The leverage brought about by the engagement of the racks 33 and the pinions 24 during the separating operation can create forces that act to incline the first housing 10 with respect to the second housing 30. However, the cam action brought about by the engagement of the cam grooves 25 and the cam followers 37 corrects the inclination of the first housing 10. Thus, the first housing 10 will not incline relative to the second housing 30, and the housings 10, 30 will separate in a proper alignment.

As described above, the connection of the first and second housings 10 and 30 is assisted by the leverage of the racks 33 and the pinions 24, which engage at positions offset from the center of rotation of the lever 20 (supporting shafts 15) in the width direction. Thus, the first housing 10 may incline. However, the cam action brought about by the engagement of the cam grooves 25 and the cam followers 37 is exhibited in a lateral region at the side of the supporting shafts 15 opposite to the racks 33 and the pinions 24 and this cam action prevents the inclination of the first housing 10. Thus, the two housings 10, 30 can be connected while being aligned properly.

The cam action brought about by the engagement of the cam grooves 25 and the cam followers 37 preferably continues until a final stage in the rotational range of the lever 20, i.e. until the two housings 10, 30 reach a properly connected state. Accordingly, the two housings 10, 30 align properly until the connecting operation is completed.

As an alternative to the above-described operation, thought has been given to a connecting operation that alternately exhibits leverage by engaging the racks 33 and the pinions 24 and the cam action by engaging the cam grooves 25 and the cam followers 37 in the process of connecting the housings 10, 30. Even in this case, the connecting operation proceeds while the inclination of the first housing 10 is corrected. Thus, the two housings 10, 30 can be connected while being aligned.

The lever-type connector requires the assembly of plural parts that are relatively movable. Thus, clearances must exist between the parts in an assembled state due to dimensional tolerances of the parts and assembling tolerances between the parts. Accordingly, exhibiting the leverage and the cam action sequentially instead of simultaneously may produce moments when neither the leverage nor the cam action is exhibited in the process of rotating the lever 20. In this case, the connecting operation of the two housings 10, 30 stops even though the lever 20 is rotated. To avoid this, dimensional accuracy has to be improved by reducing tolerances, which results in a difficult design. However, the leverage and the cam action are exhibited simultaneously in the process of rotating the lever 20 in the preferred embodiment. Thus, there is no situation where the connecting operation of the two housings 10, 30 does not proceed despite the rotation of the lever 20.

The invention is not limited to the above described and illustrated embodiment. For example, the following embodiments are also embraced by the technical scope of the present invention as defined by the claims.

The leverage brought about by the engagement of the racks and the pinions and the cam action brought about by the engagement of the cam grooves and the cam followers are exhibited at the final stage of the rotation of the lever in the above embodiment. However, either one of the leverage and the cam action may be exhibited in the entire rotational range of the lever, and the other may be exhibited only in a partial rotational range from the middle of the rotation of the lever to the completion of the rotation. Alternatively, one of the leverage and the cam action may be exhibited in the entire rotational range of the lever, and the other may be exhibited only in a partial rotational range from the start of the rotation of the lever to the completion of the rotation. Still further, either one of the leverage and the cam action may exhibited in a partial rotational range from the start of the rotation of the lever to the completion of the rotation, and the other is exhibited only in a partial rotational range from a position before the one of the leverage and the cam action is completed during the rotation of the lever to the completion of the rotation.

In the above embodiment, the leverage brought about by the engagement of the racks and the pinions is exhibited in the entire rotational range of the lever and the cam action brought about by the engagement of the cam grooves and the cam followers is exhibited only in a part of the rotational range of the lever. However, both the leverage brought about by the engagement of the racks and the pinions and the cam action brought about by the engagement of the cam grooves and the cam followers may be exhibited in the entire rotational region from the start to the end of the rotation of the lever.

Although the first housing mounted with the lever is a female housing and the second housing is a male housing including the receptacle in the above embodiment, the invention also is applicable in the case where the second housing is a female housing and the first housing is a male housing including a receptacle.

The cam grooves are formed in the lever and the cam followers are formed on the second housing in the above embodiment. However, the cam followers may be formed on the lever and the cam grooves may be formed in the second housing.

What is claimed is:

1. A lever-type connector, comprising:

a first housing;

a lever mounted rotatably on the first housing, the lever including at least one pinion;

a second housing connectable with the first housing and including at least one rack, the pinion engaging the rack so that rotating the lever produces forces between the rack and the pinion for connecting the first and second housings; and one of the lever and the second housing being formed with at least one cam groove and the other of the lever and the second housing being formed with at least one cam follower, the cam groove and the cam follower being engaged in the process of rotating the lever for preventing the first housing from being inclined with respect to the second housing about an engaged position of the pinion and the rack.

2. The lever-type connector of claim 1, wherein:

leverage brought about by the engagement of the rack and the pinion is exhibited in an entire rotational range of the lever, and cam action between the cam groove and the cam follower is exhibited only in a part of the rotational range of the lever from an intermediate rotational position of the lever to completion of the rotation.

3. The lever-type connector of claim 1, wherein the cam groove is formed in an arm of the lever without fully penetrating the arm.

4. The lever-type connector of claim 1, wherein the first housing includes a supporting shaft, the lever being mounted rotatably on the supporting shaft, an arcuate separation restricting surface being defined in a portion of the cam groove distant from the supporting shaft and an arcuate connection restricting surface being defined in a portion of the cam groove closer than the separation restricting surface to the supporting shaft and opposed to the separation restricting surface.

5. The lever-type connector of claim 4, wherein the cam groove is displaced to incline the connection restricting surface and the separation restricting surface gradually with respect to the connecting directions of the two housings.

6. The lever-type connector of claim 4, wherein the separation restricting surface of the cam groove engages the cam follower obliquely from a front side of the first housing at a side of the supporting shaft substantially opposite to the rack and the pinion in a direction inclined with respect to connecting directions of the housings.

7. The lever-type connector of claim 4, wherein an engaged position of the rack and the pinion and a position of a supporting shaft to support the lever on the first housing are offset from each other in a width direction intersecting with connecting directions of the housings.

8. The lever-type connector of claim 1, wherein the cam follower and the cam groove are not engaged yet when engagement of the rack and the pinion is started.

9. A lever-type connector, comprising:

a first housing;

a lever mounted on the first housing for rotation about a rotational axis, at least one pinion formed on the lever at a location spaced from the rotational axis, at least one cam groove formed in the lever at a location spaced from rotational axis and from the pinion so that the rotational axis is between the pinion and at least part of the cam groove;

a second housing connectable with the first housing;

at least one rack disposed on the second housing at a position for engagement by the pinion so that rotating the lever produces forces between the rack and the pinion for connecting the first and second housings; and at least one cam follower disposed on the second housing at a position for engaging the cam groove during a portion of the rotation of the lever, engagement of the cam follower with the cam groove preventing the first housing from being inclined with respect to the second housing about an engaged position of the pinion and the rack.

10. The lever-type connector of claim 9, wherein the pinion is offset to a first side of the rotational axis with respect to a connecting direction of the first and second housings and wherein the cam follower is offset to a second side of the rotational axis with respect to the rotational direction.

11. The lever-type connector of claim 9, wherein the cam follower engages the cam groove after the pinion engages the rack.

12. A method of connecting and separating a lever-type connector, comprising the following steps:

providing a first housing with a lever rotatably mounted thereon;

positioning a second housing for connection with the first housing so that a pinion on the lever is aligned for engaging a rack on the second housing;

rotating the lever so that the pinion on the lever engages the rack on the second housing for moving the first and second housings toward one another; and engaging a cam groove on one of the lever and the second housing with a cam follower on the other of the lever and the second housing for preventing the first housing from being inclined with respect to the second housing about an engaged position of the pinion and the rack.

13. The method of claim 12, wherein the step of engaging the rack and the pinion continues through an entire rotational range of the lever, and wherein the step of engaging the cam groove and the cam follower continues through only a part of the rotational range of the lever from an intermediate position to completion of the rotation.

* * * * *